US011185183B2

(12) United States Patent
Knox

(10) Patent No.: US 11,185,183 B2
(45) Date of Patent: Nov. 30, 2021

(54) PACKAGE RECEPTACLE HAVING A LOCKING MECHANISM

(71) Applicant: Jeffrey S. Knox, Voorhees, NJ (US)

(72) Inventor: Jeffrey S. Knox, Voorhees, NJ (US)

( * ) Notice: Subject to any disclaimer, the term of this patent is extended or adjusted under 35 U.S.C. 154(b) by 0 days.

(21) Appl. No.: 16/808,999

(22) Filed: Mar. 4, 2020

(65) Prior Publication Data

US 2020/0281386 A1 Sep. 10, 2020

Related U.S. Application Data

(60) Provisional application No. 62/814,975, filed on Mar. 7, 2019.

(51) Int. Cl.
*A47G 29/14* (2006.01)
*A47G 29/22* (2006.01)

(52) U.S. Cl.
CPC ..... *A47G 29/141* (2013.01); *A47G 29/22* (2013.01); *A47G 2029/145* (2013.01); *A47G 2029/147* (2013.01)

(58) Field of Classification Search
CPC ..... A47G 29/14; A47G 29/16; A47G 29/20; A47G 29/141; A47G 29/22; A47G 2029/145; A47G 2029/147; A47G 2029/148; A47G 2029/149; G06Q 10/083; G06Q 10/0832; G06Q 50/28; B64C 39/02; B64C 39/024; B64C 2201/128; B64D 1/02; B64D 1/12; B64F 1/32; E05B 65/0075; G07C 9/00912
USPC ..... 232/19, 38, 45; 340/569; 244/114 R, 244/118.1, 118.2, 137.1, 137.4; 705/330; 200/61.63
See application file for complete search history.

(56) References Cited

U.S. PATENT DOCUMENTS

| | | | | | |
|---|---|---|---|---|---|
| 5,351,883 | A * | 10/1994 | Paehl | A47G 29/12095 | 232/17 |
| 5,632,441 | A * | 5/1997 | Toval | A47G 29/1216 | 232/17 |
| 8,123,113 | B1 * | 2/2012 | Hartman | A47G 29/1216 | 232/39 |
| 10,028,606 | B1 * | 7/2018 | Ritchie | G07C 9/00912 | |
| 10,292,519 | B1 * | 5/2019 | Sutton | A47G 29/1209 | |
| 10,351,261 | B1 * | 7/2019 | Bryant | B64F 1/362 | |
| 10,730,621 | B2 * | 8/2020 | Goovaerts | A47G 29/14 | |
| 2015/0158599 | A1 * | 6/2015 | Sisko | B64F 1/20 | 244/114 R |
| 2015/0317596 | A1 * | 11/2015 | Hejazi | G06Q 10/083 | 705/330 |
| 2016/0033966 | A1 * | 2/2016 | Farris | A47G 29/141 | 701/15 |
| 2016/0257423 | A1 * | 9/2016 | Martin | B64F 1/00 | |

(Continued)

*Primary Examiner* — William L Miller
(74) *Attorney, Agent, or Firm* — Robert P. Michal, Esq.; Carter, DeLuca & Farrell LLP

(57) ABSTRACT

A package receptacle includes a storage box including a moveable platform configured to move within an inner compartment of the storage box. A door includes a locking mechanism. The locking mechanism is releasable by a signal to open the door. An antenna is in communication with the storage box. The antenna is configured to deliver the signal to the locking mechanism of the door. The moveable platform is configured to move from an upper portion of the inner compartment of the storage box toward a lower portion of the inner compartment of the storage box.

14 Claims, 2 Drawing Sheets

(56) References Cited

U.S. PATENT DOCUMENTS

| | | | | |
|---|---|---|---|---|
| 2017/0203857 | A1* | 7/2017 | O'Toole | A47G 29/141 |
| 2018/0070753 | A1* | 3/2018 | Eveloff | H04W 4/025 |
| 2018/0290764 | A1* | 10/2018 | Mcmillian | G08G 5/0026 |
| 2018/0352988 | A1* | 12/2018 | Ortiz | E05B 65/06 |
| 2019/0039751 | A1* | 2/2019 | Janssen | B64C 39/024 |
| 2019/0167025 | A1* | 6/2019 | Cherry | A47G 29/16 |
| 2020/0180880 | A1* | 6/2020 | Gil | B65G 67/00 |
| 2020/0359819 | A1* | 11/2020 | Roberts | A47G 29/16 |
| 2020/0393742 | A1* | 12/2020 | Dion | A47G 29/141 |

* cited by examiner

PACKAGE RECEPTACLE HAVING A LOCKING MECHANISM

TECHNICAL FIELD

The present disclosure relates to a package receptacle, and more particularly, to a package receptacle having a locking mechanism.

BACKGROUND

Consumers are increasingly having packages delivered to both residential and business locations. Generally, a precise time at which a package will be delivered is unknown by a consumer prior to delivery. Thus, delivery drivers will often arrive at a delivery site that is unoccupied, or at which an intended package recipient is unavailable. Many such packages are left at the delivery site without a signature of the intended package recipient. Thus, an intended package recipient may be unable to take possession of and secure a delivered package upon delivery of the package. As a result, theft of the delivered package or damage to the delivered package as a result of exposure to the elements may occur prior to the intended recipient taking possession of the delivered package. Thus, damage to delivered goods may result in financial damage to the intended recipient, or to the party shipping the delivered goods.

As an example, a delivered package may be left on an intended recipient's doorstep many hours before the intended recipient arrives at the delivery site. Alternatively, a package may be delivered to an incorrect address while a resident of the incorrect address is unavailable to refuse delivery.

Thus, it may be more desirable to deliver packages to a secure storage location that can be remotely monitored or controlled by an intended package recipient.

SUMMARY

According to aspects of the present disclosure, a package receptacle includes a storage box including a moveable platform configured to move within an inner compartment of the storage box. A door includes a locking mechanism. The locking mechanism is releasable by a signal to open the door. An antenna is in communication with the storage box. The antenna is configured to deliver the signal to the locking mechanism of the door. The moveable platform is configured to move from an upper portion of the inner compartment of the storage box toward a lower portion of the inner compartment of the storage box.

According to aspects of the present disclosure, a camera may be positioned on the storage box. The camera may be positioned to capture an image of the inner compartment of the storage box.

According to aspects of the present disclosure, the antenna may be a cellular network antenna configured to receive a cellular network signal to open the door, a Bluetooth antenna configured to receive a Bluetooth signal to open the door, or a WiFi antenna configured to receive a WiFi signal to open the door.

According to aspects of the present disclosure, a storage box includes a moveable platform configured to move within an inner compartment of the storage box. A door includes a locking mechanism. The locking mechanism may be releasable by a remote signal to open the door. A cellular network antenna may be in communication with the storage box. The cellular network antenna is configured to deliver the remote signal to the locking mechanism of the door. A camera is positioned on the storage box to capture an image of the inner compartment of the storage box. The moveable platform is configured to move from an upper portion of the inner compartment of the storage box toward a lower portion of the inner compartment of the storage box when a package is positioned on the moveable platform.

According to aspects of the present disclosure, the moveable platform may be moveably coupled to a plurality of stabilizing bars secured to the storage box.

According to aspects of the present disclosure, the package receptacle may include a battery configured to power the package receptacle. The battery may be rechargeable. A solar panel may be configured to charge the battery. The solar panel may be positioned on the door.

According to aspects of the present disclosure, the package receptacle may include an outer shell surrounding the storage box. An insulating layer may be positioned between the outer shell and the storage box.

According to aspects of the present disclosure, the package receptacle may include a heater, or a refrigerator configured to regulate a temperature of the storage box.

According to aspects of the present disclosure, the package receptacle may include a landing platform configured to support an unmanned aerial vehicle.

According to aspects of the present disclosure, the storage box may be waterproof.

According to aspects of the present disclosure, the storage box may include carbon fibers or plastic.

According to aspects of the present disclosure, the package receptacle may include a sensor configured to detect a position of an object in the storage box with respect to an uppermost level of the storage box.

According to aspects of the present disclosure, the storage box may be configured to be positioned below ground.

According to aspects of the present disclosure, a subterranean package receptacle includes a storage box including a moveable platform configured to move within an inner compartment of the storage box. The storage box may be substantially waterproof. An outer shell may surround the storage box. An insulating layer may be between the outer shell and the storage box. An upper lid may include a locking mechanism. The locking mechanism may be releasable by a remote signal to open the upper lid. A cellular network antenna may be in communication with the storage box. The cellular network antenna may be configured to deliver the remote signal to the locking mechanism of the upper lid. A camera may be positioned on the storage box to capture an image of the inner compartment of the storage box. The moveable platform may be configured to move from an upper portion of the inner compartment of the storage box toward a lower portion of the inner compartment of the storage box when a package is positioned on the moveable platform.

According to aspects of the present disclosure, a subterranean package receptacle includes a storage box including a moveable platform configured to move within an inner compartment of the storage box. An upper lid includes a locking mechanism. The locking mechanism is releasable by a remote signal to open the upper lid. A cellular network antenna is in communication with the storage box. The cellular network antenna is configured to deliver the remote signal to the locking mechanism of the upper lid. A camera is positioned on the storage box to capture an image of the inner compartment of the storage box. The moveable platform is configured to move from an upper portion of the inner compartment of the storage box toward a lower portion of the inner compartment of the storage box when a package is positioned on the moveable platform.

BRIEF DESCRIPTION OF THE FIGURES

The above and other features of the present disclosure will become more apparent by describing in detail exemplary embodiments thereof, with reference to the accompanying drawings, in which.

DETAILED DESCRIPTION

Figure 1:
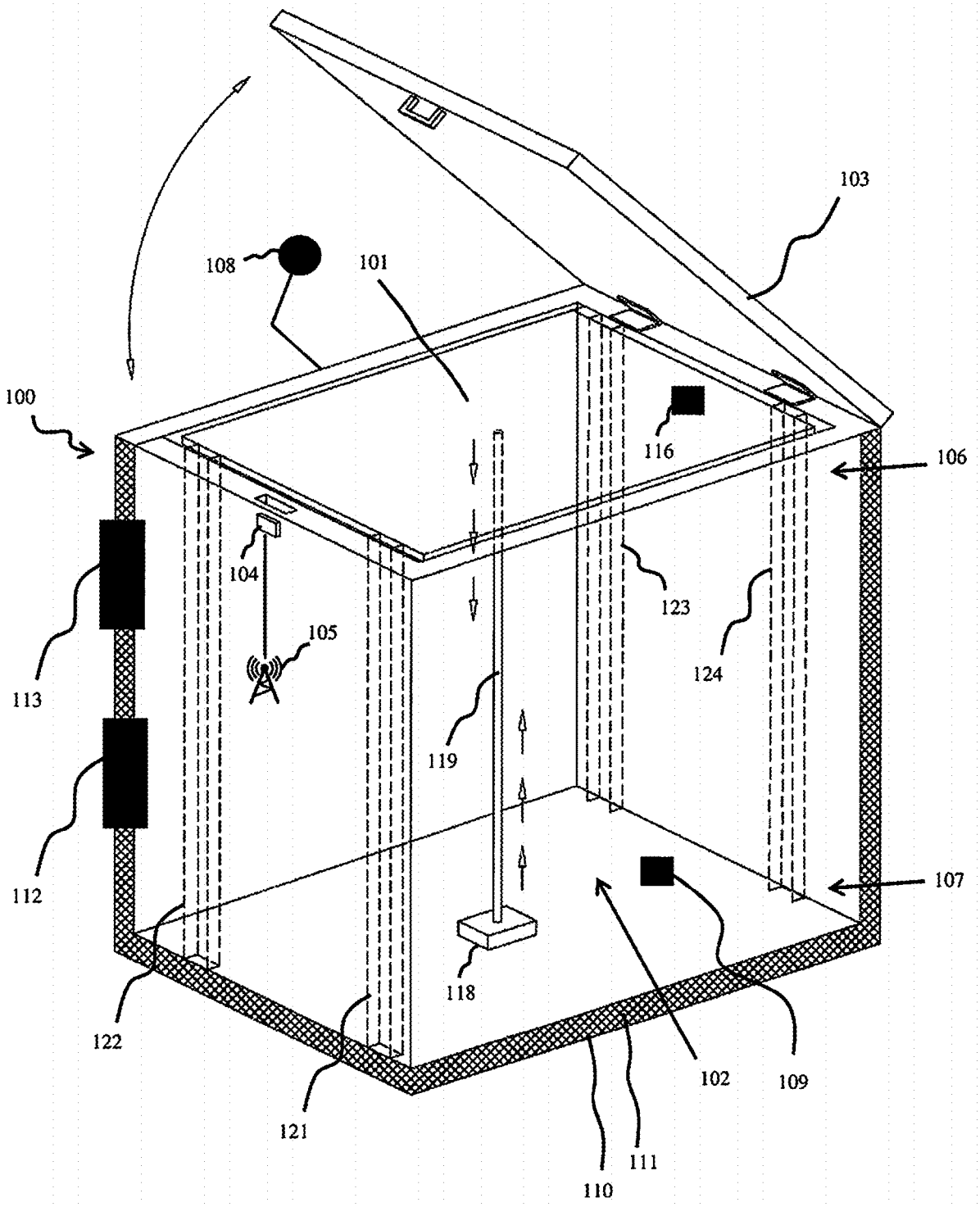
FIG. 1 is a perspective view of a package receptacle according to an exemplary embodiment of the present disclosure.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

As used herein, the terms parallel and perpendicular are understood to include relative configurations that are substantially parallel and substantially perpendicular up to about + or −10 degrees from true parallel and true perpendicular.

"About" or "approximately" as used herein may be inclusive of the stated value and means within an acceptable range of variation for the value as determined by one of ordinary skill in the art, considering the measurement in question and the error associated with measurement of the particular quantity (e.g., the limitations of the measurement system). For example, "about" may mean within one or more standard variations, or within ±30%, 20%, 10%, 5% of the stated value.

Descriptions of technical features or aspects of an exemplary embodiment of the present disclosure should typically be considered as available and applicable to other similar features or aspects in another exemplary embodiment of the present disclosure. Accordingly, technical features described herein according to one exemplary embodiment of the present disclosure may be applicable to other exemplary embodiments of the present disclosure, and thus duplicative descriptions may be omitted herein.

Exemplary embodiments of the present disclosure will be described more fully below (e.g., with reference to the accompanying drawings). Like reference numerals may refer to like elements throughout the specification and drawings.

Figure 2:
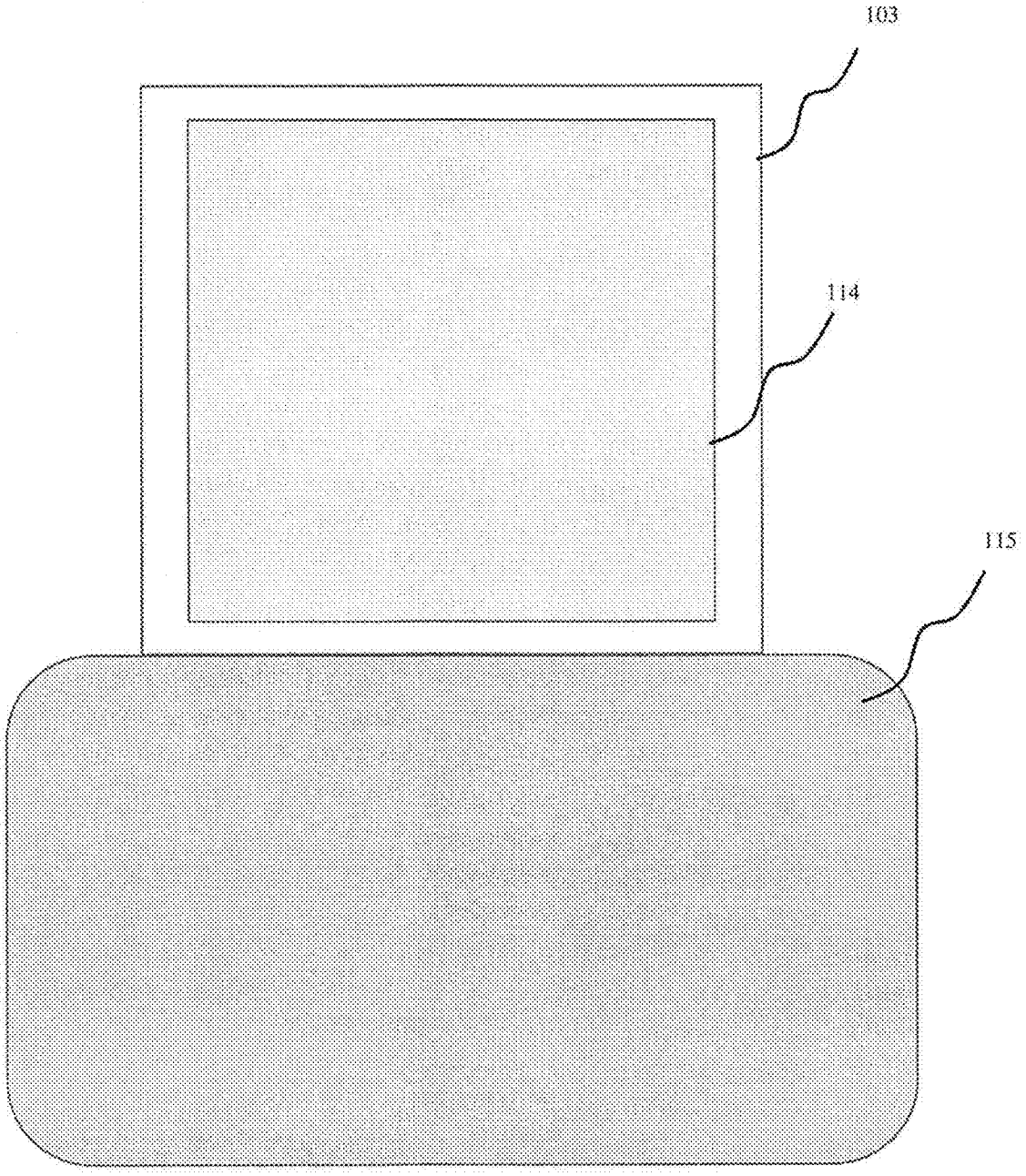
FIG. 2 is a top plan view of a package receptacle according to an exemplary embodiment of the present disclosure.

FIG. 1 is a perspective view of a package receptacle according to an exemplary embodiment of the present disclosure. FIG. 2 is a top plan view of a package receptacle according to an exemplary embodiment of the present disclosure.

Referring to FIGS. 1 to 2, according to an exemplary embodiment of the present disclosure, a package receptacle includes a storage box 100 including a moveable platform 101 configured to move within an inner compartment 102 of the storage box 100. A door 103 includes a locking mechanism 104. The locking mechanism 104 is releasable by a signal to open the door 103. An antenna 105 is in communication with the storage box 100. The antenna 105 is configured to deliver the signal to the locking mechanism 104 of the door 103. The moveable platform 101 is configured to move from an upper portion 106 of the inner compartment 102 of the storage box toward or away from a lower portion 107 of the inner compartment 102 of the storage box 100.

As described in more detail below, a user may selectively control locking or unlocking of the storage box 100. For example, a user may set the storage box 100 to unlock and/or to open based on proximity of an authorized individual or an authorized automated delivery vehicle (e.g., an unmanned aerial vehicle). The phrases "drone" and "unmanned aerial vehicle" may be used interchangeably herein. Thus, the storage box 100 is only accessible according to a user's control. Further, delivered packages may be safely secured and held until a user of the storage box 100 opens the storage box 100 and removes the package. As a result, theft or damage to a delivered package (e.g., as a result of exposure to the elements) may be prevented, thus preventing a financial loss resulting from lost, stolen or damaged packages.

According to an exemplary embodiment of the present disclosure, the moveable platform 101 may be moveable by a push rod 119. The push rod 119 may be coupled to a stop block 118 configured to stop a downward motion of the moveable platform 101. The storage box 100 may include a scale associated with the push rod 119 and/or with the stop block 118 to gauge a weight of a package positioned on the moveable platform 101. Lowering of the moveable platform 101 may allow additional packages to fit in the storage box 100 without positioning such packages unnecessarily far below an upper level of the storage box 100. Thus, a user may relatively easily remove delivered packages from the storage box 100. Additionally, the moveable platform 101 may determine that a package of approximately an expected weight has been positioned on the moveable platform 101 in the storage box 100.

According to an exemplary embodiment of the present disclosure, a camera 108 may be positioned on or around the storage box 100. The camera 108 may be positioned to capture an image (e.g., still or video images) of the inner compartment 102 of the storage box 100. The camera 108 may be additionally or alternatively positioned to capture images of an area surrounding the storage box 100. The captured images may be transmitted to a user of the storage box 100 by use of the antenna 105 described in more detail below.

According to an exemplary embodiment of the present disclosure, the antenna 105 may be a cellular network antenna configured to receive a cellular network signal to open the door, a Bluetooth antenna configured to receive a Bluetooth signal to open the door, and/or a WiFi antenna configured to receive a WiFi signal to open the door. The antenna may be used to receive a release signal from a user of the storage box 100 and/or to transmit data captured by the storage box 100 to the user of the storage box 100. The antenna may also be used to communicate information from or to a user of the storage box 100. For example, a Smartphone application may be employed to control the storage box 100 and/or to receive and display data captured by the storage box 100 to the user.

According to an exemplary embodiment of the present disclosure, a storage box 100 includes a moveable platform 101 configured to move within an inner compartment 102 of the storage box 100. A door 103 includes a locking mechanism 104. The locking mechanism 104 may be releasable by a remote signal to open the door 103. A cellular network antenna (e.g., antenna 105 may be a cellular network antenna) may be in communication with the storage box 100. The cellular network antenna is configured to deliver the remote signal to the locking mechanism 104 of the door 103. A camera 108 is positioned on the storage box 100 to capture an image of the inner compartment 102 of the storage box 100. The moveable platform 101 is configured to move from an upper portion 106 of the inner compartment 102 of the storage box 100 toward a lower portion 107 of the inner compartment 102 of the storage box 100 when a package is positioned on the moveable platform 101.

While a package is described as being positioned in the storage box 100, exemplary embodiment of the present disclosure are not limited thereto. For example, objects other than a package may be positioned and/or stored in the storage box 100. The remote signal delivered to unlock the storage box 100 may be a proximity signal generated by an authorized individual or vehicle instructing the storage box 100 to open based on a user's authorization. An authorized individual or authorized delivery vehicle may carry a barcode scanned by a barcode scanner associated with the storage box 100 to unlock or access the storage box 100. As an example, the storage box 100 may include a general-purpose computer having a processor and a memory configured to control the functioning of the storage box. The user may access the computer through a Cellular Network connection, a Bluetooth connection or a WiFi connection. Thus, the storage box 100 may be set to be opened or locked based on a user's preferences and control.

According to an exemplary embodiment of the present disclosure, the storage box 100 may include more than one of, or each of, a cellular network antenna configured to receive a cellular network signal to open the door, a Bluetooth antenna configured to receive a Bluetooth signal to open the door, and a WiFi antenna configured to receive a WiFi signal to open the door. The antenna may be used to receive a release signal from a user of the storage box 100 and/or to transmit data captured by the storage box 100 to the user of the storage box 100. For example, a Smartphone application may be employed to control the storage box 100 and/or to receive and display data captured by the storage box 100 to the user.

According to an exemplary embodiment of the present disclosure, the moveable platform 101 may be moveably coupled to a plurality of stabilizing bars (e.g., stabilizing bars 121, 122, 123 and/or 124) secured to the storage box 100. The stabilizing bars may be secured to side surfaces of the storage box 100; however, exemplary embodiments of the present disclosure are not limited thereto. For example, the stabilizing bars may be spaced apart from side walls of the storage box 100. As an example, the stabilizing bars may project through holes formed in the moveable platform 101, and the moveable platform 101 may slide up and down along the stabilizing bars. The moveable platform 101 may move within the storage box (e.g., along the stabilizing bars by a motor providing a force along the stabilizing bars). As an example, the moveable platform 101 may be substantially parallel with an uppermost level of the storage box 100.

As an example, the moveable platform 101 may be moveable by a push rod 119. The push rod 119 may be coupled to a stop block 118 configured to stop a downward motion of the moveable platform 101. The storage box 100 may include a scale associated with the push rod 119 and/or with the stop block 118 to gauge a weight of a package or other object positioned on the moveable platform 101. However, exemplary embodiments of the present disclosure are not limited thereto. For example, the push rod 119 and/or the stop block 118 may be omitted, as desired.

As an example, the door 103 may include at least one hinge. For example, the at least one hinge may be coupled to an upper sidewall of the storage box 100. Upon release of the locking mechanism 104, the door 103 may be opened by a force applied (e.g., a force applied to the door 103 through the at least one hinge being rotated about a pin) by a pneumatic actuator configured to move the door 103 about the at least one hinge. Thus, the door 103 may be opened in an upward direction. However, exemplary embodiments of the present disclosure are not limited thereto, and the door may open in any desired direction.

As an example, the storage box 100 described herein may be positioned in a subterranean location. An upper surface (e.g., a top of the door 103) may be substantially even or parallel with a level of an area surrounding the storage box 100. This may prevent the formation of an indent in the ground at the site of the storage box 100. Thus, the storage box 100 may be positioned in a driveway or another area which a car or other vehicle passes over without causing damage to such a car or vehicle. Alternatively, the storage box 100 may be positioned above-ground or may be positioned at an elevated height (e.g., on a roof or an elevated platform).

According to an exemplary embodiment of the present disclosure, the features and principles of the storage box 100 described herein may be similarly applied to a door (e.g., of a delivery site, building, house or a shed) or to any access point for a desired delivery location.

According to an exemplary embodiment of the present disclosure, the package receptacle may include a battery 109 configured to power the package receptacle. The battery 109 may be rechargeable. A solar panel (e.g., solar panel 114) may be configured to charge the battery 109. The solar panel may be positioned on the door 103. For example, the solar panel may be an integrated component of the storage box 100 and may be positioned on an upper surface of the door 103. Alternatively, the solar panel may be positioned in the general area of the storage box 100 and may be connected with the battery 109.

According to an exemplary embodiment of the present disclosure, the package receptacle may include an outer shell 110 surrounding the storage box 100. An insulating layer 111 may be positioned between the outer shell 110 and an inner wall of the storage box 100. Thus, a desired temperature within the storage box 100 and/or desired humidity levels may be maintained in the storage box 100. Further, controlling a heat level within or around the storage box 100 may prevent ice formation on or around the storage box 100. This may prevent the storage box 100 from being frozen in a closed state.

According to an exemplary embodiment of the present disclosure, the package receptacle may include a heater 112 or a refrigerator 113 configured to regulate a temperature of the storage box 100.

According to an exemplary embodiment of the present disclosure, the package receptacle may include a landing platform 115 configured to support an unmanned aerial vehicle. The landing platform 115 may be coupled to the storage box 100 or may be positioned within the vicinity of the storage box 100. The storage box 100 may include a mechanism to detect the presence of the unmanned aerial vehicle. For example, a weight detector in the landing platform 115 may detect that an unmanned aerial vehicle has landed. The package receptacle may include a detector capable of detecting a unique signature of the unmanned aerial vehicle and may only allow the storage box 100 to be opened when an authorized aerial vehicle has landed. For example, the unmanned aerial vehicle may physically dock with the package receptacle to deliver a digital identification signal. Alternatively, a Bluetooth or Wi-Fi communication connection may be initiated between the unmanned aerial vehicle and the package receptacle to verify the identity of the unmanned aerial vehicle.

According to an exemplary embodiment of the present disclosure, the storage box 100 may be waterproof. Thus, damage to a package or other object positioned in the storage box 100 may be prevented.

According to an exemplary embodiment of the present disclosure, the storage box 100 may include carbon fibers or plastic (e.g., the outer shell 110 of the storage box 100 may include carbon fibers or plastic). This may maximize durability, while minimizing weight of the storage box 100.

According to an exemplary embodiment of the present disclosure, the package receptacle may include a sensor 116 (e.g., an infrared or laser sensor) configured to detect a position of an object in the storage box 100 with respect to an uppermost level of the storage box 100.

According to an exemplary embodiment of the present disclosure, the storage box 100 may be configured to be positioned below ground.

According to an exemplary embodiment of the present disclosure, a subterranean package receptacle includes a storage box 100 including a moveable platform 101 configured to move within an inner compartment 102 of the storage box 100. The storage box 100 may be substantially waterproof. An outer shell 110 may surround the storage box 100. An insulating layer 111 may be between the outer shell 110 and an inner sidewall of the storage box 100. An upper lid (e.g., the door 103) may include a locking mechanism 104. The locking mechanism 104 may be releasable by a remote signal to open the upper lid. A cellular network antenna (e.g., antenna 105) may be in communication with the storage box 100. The cellular network antenna may be configured to deliver the remote signal to the locking mechanism 104 of the upper lid. A camera 108 may be positioned on the storage box 100 to capture an image of the inner compartment 102 of the storage box 100. The moveable platform 101 may be configured to move from an upper portion 106 of the inner compartment 102 of the storage box 100 toward a lower portion 107 of the inner compartment 102 of the storage box 100 when a package is positioned on the moveable platform 101.

As an example, a user of the storage box 100 may remotely connect with the storage box 100 via a WiFi, Bluetooth or Cellular Network connection, visualize the area in or around the storage box 100 via the camera 108, and may manually authorize opening of the upper lid by releasing the locking mechanism 104.

According to an exemplary embodiment of the present disclosure, a subterranean package receptacle includes a storage box 100 including a moveable platform 101 configured to move within an inner compartment 102 of the storage box 100. An upper lid (e.g., the door 103) includes a locking mechanism 104. The locking mechanism 104 is releasable by a remote signal to open the upper lid. A cellular network antenna (e.g., antenna 105) is in communication with the storage box 100 (e.g., may be disposed directly on the storage box 100). The cellular network antenna is configured to deliver the remote signal to the locking mechanism 104 of the upper lid. A camera 108 is positioned on the storage box 100 to capture an image of the inner compartment 102 of the storage box 100.

Having described exemplary embodiments of the present disclosure, it is further noted that it is readily apparent to those of ordinary skill in the art that various modifications may be made without departing from the spirit and scope of the present disclosure.

What is claimed is:

1. A package receptacle, comprising:

a storage box including a moveable platform configured to move within an inner compartment of the storage box;

a door including a locking mechanism, wherein the locking mechanism is releasable by a signal to open the door; and an antenna in communication with the storage box, wherein the antenna is configured to deliver the signal to the locking mechanism of the door, wherein the moveable platform is configured to move from an upper portion of the inner compartment of the storage box toward a lower portion of the inner compartment of the storage box when the package is positioned on the moveable platform, and wherein the moveable platform is moveably coupled to a plurality of stabilizing bars secured to the storage box.

2. The package receptacle of claim 1, wherein a camera is positioned on the storage box, and wherein the camera is positioned to capture an image of the inner compartment of the storage box.

3. The package receptacle of claim 1, wherein the antenna is a cellular network antenna configured to receive a cellular network signal to open the door, a Bluetooth® antenna configured to receive a Bluetooth signal to open the door, or a WiFi® antenna configured to receive a WiFi® signal to open the door.

4. A storage box, comprising:

a moveable platform configured to move within an inner compartment of the storage box;

a door including a locking mechanism, wherein the locking mechanism is releasable by a remote signal to open the door;

a cellular network antenna in communication with the storage box, wherein the cellular network antenna is configured to deliver the remote signal to the locking mechanism of the door; and a camera is positioned on the storage box to capture an image of the inner compartment of the storage box, wherein the moveable platform is configured to move from an upper portion of the inner compartment of the storage box toward a lower portion of the inner compartment of the storage box when a package is positioned on the moveable platform, and wherein the moveable platform is moveably coupled to a plurality of stabilizing bars secured to the storage box.

5. The storage box of claim 4, wherein the package receptacle may include a battery configured to power the package receptacle, wherein the battery is rechargeable, wherein a solar panel is configured to charge the battery, and wherein the solar panel is positioned on the door.

6. The storage box of claim 4, wherein the package receptacle further includes an outer shell surrounding the storage box, wherein an insulating layer is positioned between the outer shell and the storage box.

7. The storage box of claim 4, wherein the package receptacle further includes at least one of a heater, or a refrigerator configured to regulate a temperature of the storage box.

8. The storage box of claim 4, wherein the package receptacle further includes a landing platform configured to support an unmanned aerial vehicle.

9. The storage box of claim 4, wherein the storage box is waterproof.

10. The storage box of claim 4, wherein the storage box further includes carbon fibers or plastic.

11. The storage box of claim 4, wherein the package receptacle further includes a sensor configured to detect a position of an object in the storage box with respect to an uppermost level of the storage box.

12. The storage box of claim 4, wherein the storage box is configured to be positioned below ground.

13. A subterranean package receptacle, comprising:

a storage box including:

a moveable platform configured to move within an inner compartment of the storage box, wherein the storage box is substantially waterproof;

an outer shell surrounds the storage box;

an insulating layer between the outer shell and the storage box;

an upper lid may include a locking mechanism, wherein the locking mechanism is releasable by a remote signal to open the upper lid;

a cellular network antenna is in communication with the storage box, wherein the cellular network antenna is configured to deliver the remote signal to the locking mechanism of the upper lid; and a camera is positioned on the storage box to capture an image of the inner compartment of the storage box, wherein the moveable platform is configured to move from an upper portion of the inner compartment of the storage box toward a lower portion of the inner compartment of the storage box when a package is positioned on the moveable platform, and wherein the moveable platform is moveably coupled to a plurality of stabilizing bars secured to the storage box.

14. A subterranean package receptacle, comprising:

a storage box including:

a moveable platform configured to move within an inner compartment of the storage box;

an upper lid including a locking mechanism, wherein the locking mechanism is releasable by a remote signal to open the upper lid;

a cellular network antenna is in communication with the storage box, wherein the cellular network antenna is configured to deliver the remote signal to the locking mechanism of the upper lid; and a camera is positioned on the storage box to capture an image of the inner compartment of the storage box, wherein the moveable platform is configured to move from an upper portion of the inner compartment of the storage box toward a lower portion of the inner compartment of the storage box when a package is positioned on the moveable platform, and wherein the moveable platform is moveably coupled to a plurality of stabilizing bars secured to the storage box.

* * * * *